United States Patent [19]

Zawitz

[11] Patent Number: 4,509,929

[45] Date of Patent: Apr. 9, 1985

[54] ANNULAR SUPPORT DEVICE WITH PIVOTAL SEGMENTS

[76] Inventor: Richard E. Zawitz, 109 Alton St., San Francisco, Calif. 94115

[21] Appl. No.: 412,118

[22] Filed: Aug. 27, 1982

[51] Int. Cl.[3] ..... A63H 33/12

[52] U.S. Cl. ..... 446/102; 446/121

[58] Field of Search ..... 46/1 R, 25, 28, 26, 46/24, 23, 16, 29; 403/328, 361

[56] References Cited

U.S. PATENT DOCUMENTS

| | | | |
|---|---|---|---|
| 1,611,488 | 12/1926 | Rocquin et al. | 403/328 X |
| 1,852,071 | 4/1932 | Becker | 403/328 X |
| 2,073,346 | 3/1937 | Clow . | |
| 2,703,724 | 3/1955 | Der Yuen et al. | 46/29 UX |
| 3,222,072 | 12/1965 | Dreyer . | |
| 3,469,339 | 9/1969 | Thomas . | |
| 3,514,893 | 6/1970 | Paksy . | |
| 3,597,872 | 10/1971 | Venaela et al. . | |
| 3,900,984 | 8/1975 | Garelick | 46/26 X |
| 3,977,683 | 8/1976 | Tomura . | |
| 4,012,155 | 3/1977 | Morris | 46/29 X |
| 4,031,635 | 6/1977 | Brandt et al. . | |
| 4,071,244 | 1/1978 | Richards . | |
| 4,106,657 | 8/1978 | Dogliotti | 46/25 X |
| 4,184,271 | 1/1980 | Barnett, Jr. . | |
| 4,214,747 | 7/1980 | Rebajes . | |
| 4,232,473 | 11/1980 | Jenkins | 46/25 X |
| 4,259,821 | 4/1981 | Bush . | |
| 4,325,698 | 4/1982 | Darling et al. . | |
| 4,362,031 | 12/1982 | Obermuller | 63/10 X |

FOREIGN PATENT DOCUMENTS 2503780 5/1976 Fed. Rep. of Germany .

1195407 6/1959 France .

*Primary Examiner*—Mickey Yu

*Attorney, Agent, or Firm*—Fleit, Jacobson, Cohn & Price

[57] ABSTRACT

An annular support device is formed by a series of identical torus segments with adjacent segments connected end-to-end in a continuous loop. One end face of each segment has a central extension, and the other end face has a central channel for receiving the extension of the adjacent torus segment. The extension-channel interface between adjacent segments defines a twisting axis permitting each segment to be twisted through 360 degrees relative to the other segments. The support device may be twisted into an infinite variety of decorative and useful configurations. Each end face has a raised peripheral rim which abuts with an identical cooperating peripheral rim on the opposed face of the adjacent segment. The rims are circular and define a common interface plane perpendicular to the twist axis therebetween. The torus curve causes the twist axis at each end of a segment to be non-aligned, and prevents individual segments from being twisted relative to both adjacent segments simultaneously. The non-alignment locks each segment in place, and can be displaced only as part of a larger group of segments. The random orientations of the other twisting axis tend to oppose displacement of the segments causing the annular device to retain the present configuration. The twist axis through each extension-channel interface passes through the center of the opposed circular rims. The torus surface of each segment is flush and continuous with the torus surface of the adjacent segments.

20 Claims, 10 Drawing Figures

ANNULAR SUPPORT DEVICE WITH PIVOTAL SEGMENTS

TECHNICAL FIELD

This invention relates to an annular device formed by a plurality of pivotally connected segments, and more particularly to such an annular device which may be twisted into an infinite variety of useful and decorative structures.

BACKGROUND

U.S. Pat. No. 4,232,473 to Jenkins teaches a novelty toy device for forming geometric configurations. The segments of Jenkins are right angle elbows with straight legs, without a continuous center line of symmetry. The collective visual effect of Jenkins lacks grace. The Jenkins twisting axis tend to align along the three major geometric axis (X, Y, and Z), reducing the configuration retention ability of the overall device. Jenkins has a center leg for creating two closed loops, which severely limits the flexibility and scope of configurations.

SUMMARY

It is therefore an object of this invention to provide an annular device of pivotally connected segments which may be twisted into many useful configurations.

It is a further object of this invention to provide such an annular device which tends to retain the configuration set by the user.

It is another object of this invention to provide such an annular device which may be fixed in the configuration set by the user.

It is another object of this invention to provide such an annular device which may be twisted into an infinite number of graceful, decorative configurations.

It is another object of this invention to provide such an annular device which functions as a diversion tranquilizer by occupying the users hands and attention.

It is another object of this invention to provide such an annular device which may be employed as a toy or puzzle.

Briefly, these and other objects of the present invention are accomplished by providing a plurality of serially connected rigid segments forming a continuous annular device which may be twisted into an infinite number of configurations. The ends of each segment are pivotally secured to the adjacent segments for permitting the twisting. Each configuration has a continuous center line therearound. The end faces on each segment are circular and normal to the center line defining an interface plane between each pair of adjacent segments. The pivot axis between adjacent segments is normal to the interface plane. Engagement means on adjacent segments secure the segments together.

BRIEF DESCRIPTION OF THE DRAWING

Further objects and advantages of decorative, support device; and the operation of the pivotally connected segments will become apparent from the following detailed description and drawing in which.

GENERAL DESCRIPTION FIGS. 1 and 2

Figure 1A:
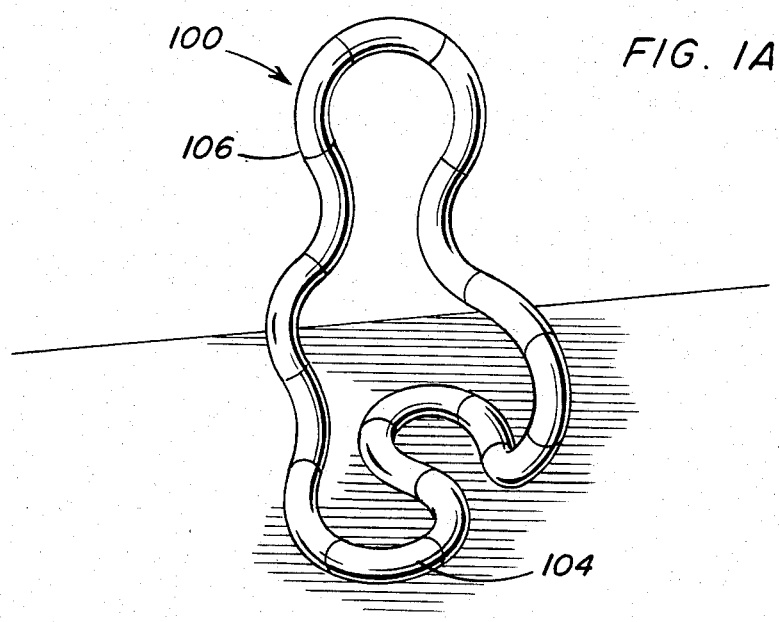
FIG. 1A is a perspective view of an annular device having torus segments in a random decorative configuration.
Figure 1B:
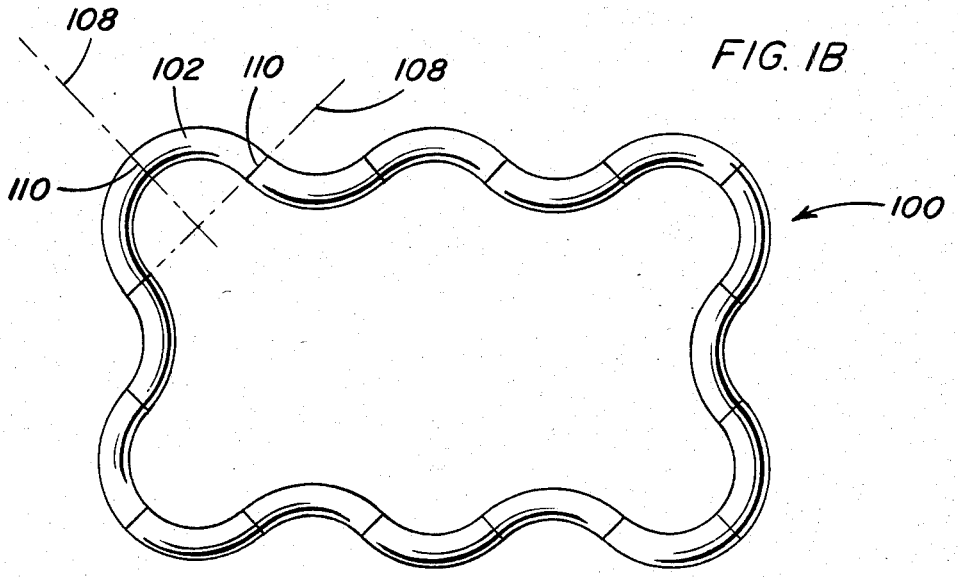
FIG. 1B is a plan view of the annular device of FIG. 1A in a flat configuration showing the torus segments and the twisting axis at the interface between segments.

Annular device 100 is formed by a plurality of pivotally connected segments 102, which may be twisted into an infinite variety of configurations such as the unique and decorative sculpture shown in FIG. 1A. Coplanar base portion 104 rests on the display surface, and supports smoothly curving upper portion 106. The sculpture in the FIG. 1 embodiment has sixteen segments which can be seen in the flat configuration shown in FIG. 1B. Every segment 102 has a twisting axis 108 at each end thereof which pass through an end interface 110 between each pair of adjacent segments. Each segment may be twisted relative to either adjacent segment through 360 degrees by displacing or flipping the remainder of annular device 100.

Figure 2A:
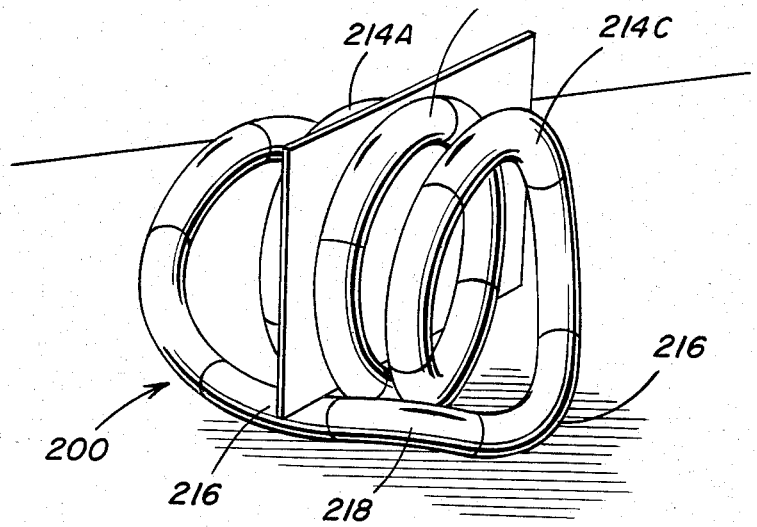
FIG. 2A is a perspective view of an annular device in a vertical coiled embodiment which is useful as a desk organizer.
Figure 2B:
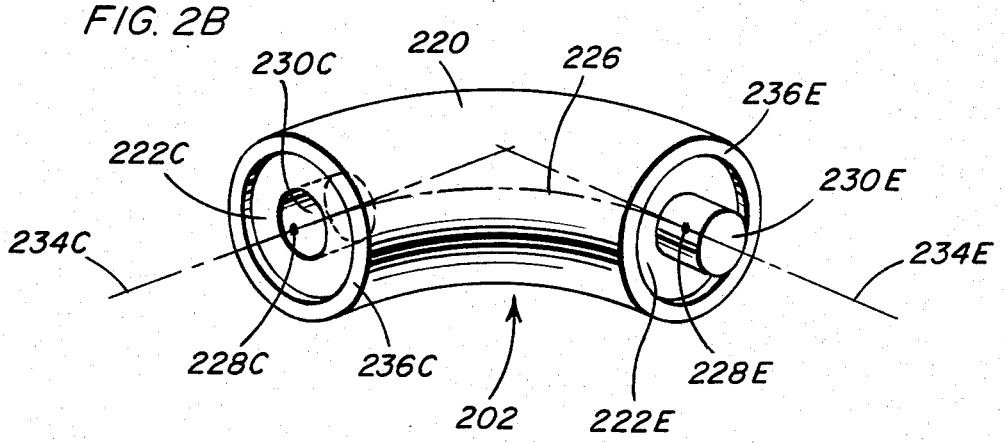
FIG. 2B is a perspective view of a 90 degree torus segment used to form the embodiments of FIG. 1 and 2.

Utilitarian embodiments, such as helical desk organizer 200 shown in FIG. 2A, may also be obtained by twisting segments 202. Adjacent helical loops 214A, 214B, and 214C form separation dividers for containing small, frequently used items, such as letters and file cards. Each loop 214 is supported at a bottom point by the supporting surface (desk top). Stabilizer portion 218 extends from the ends of the helix to engage the support surface at remote points 216 for preventing the helix from rolling. The helix may be expanded axially to increase the separation between dividers 214 to accomodate thicker items.

The file holder embodiment 200 of FIG. 2A is formed by eighteen identical torus segments 202 connected end-to-end to form a continuous annular device. Each segment 202 is a 90 degree section of a torus (shown in FIG. 2B), having a curved body portion 220, with face 222E at one end and face 222C at the other end.

Center line of symmetry 226 of curved body portion 220 is a 90 degree arc defining the plane of the torus segment. Center line 226 has end points 228E and 228C. Each end face 222 defines an interface plane containing end points 228, and which is perpendicular to center line 226 at end points 228, and perpendicular to the plane of the torus segment. The interface planes are also perpendicular to each other in the in the 90 degree embodiment of FIG. 2B.

End face 222E of each segment has a cylindrical central extension 230E, with a straight central axis 234E extending perpendicular to the interface plane. Axis 234E is tangent to curved center line 226 at end point 228E thereof. End face 222C of each segment has a cooperating cylindrical central channel 230C with a central axis 234C extending perpendicular to the interface plane. Axis 234C is tangent to curved center line 226 at end point 228C thereof.

The central channel of each torus segment in annular device 200 receives the central extension of the adjacent torus segment, forming an extension-channel interface. Center axis 234E and 234C of each interface coincide defining a common pivoting or twisting axis. Chain 200 may be twisted into a infinite number of random configurations; each of which has continuous closed center line of symmetry formed by center line 226 through each segment. End points 228 of adjacent center lines remain coincident regardless of the complexity of the configuration of annular device.

End faces 222 have raised peripheral rims 236E and 236C which abut with an identical cooperating peripheral rims on the adjacent segment. Rims 236 are circular and define the common interface plane therebetween.

CONFIGURATION RETENTION

The annular device has an amazing retention property, which causes the segments thereof to remain in the last configuration set by the user. The annular device is readily twistable into new configurations, but tends to retain the prior configuration until retwisted. Preferably, each extension fits snugly into the cooperating channel of the adjacent segment, which aids the retention property. In addition, some configurations have points of contact between segments that touch (and with the support surface). These contact points permit mutual leaning and support, which also aids configuration retention.

Another source of retention is due to the subtle relationship between the interface twisting axes. The twisting axis are randomly oriented. The probability of two axis being perfectly aligned or coincident in a given configuration is highly remote. Such alignments, when they do occur, offer less resistance to pivoting because they involve the snug-static friction of only the aligned interfaces. In the usual non-aligned case more interfaces are involved, and entire sections of the annular device must be simultaneously twisted and shifted as a unit in order to move a single segment.

The torus curve along each segment body portion, causes the two twisting axis of each segment to be non-aligned (at ninety degrees in the FIG. 2 embodiment). A single segment can not be twisted relative to both adjacent segments at the same time, without displacing other segments within the annular device. The segments can not be displaced independently.

Even in the unusual case of axis alignment, the segments between the aligned interfaces can pivot or be displaced only as part of the group of adjacent segments bounded by the pair of aligned axis. These locked groups may be large (the entire annular device) or small (four minimum) depending on the configuration. Each locked group must have at least four torus quadrant segments in order to present an accumulated axis shift of 360 degrees required for axis alignment.

Typically when the user initially twists the annular device, the twisting axis are random and non-aligned. The initial locked group includes the entire chain of segments. The force required to displacement a single segment must be sufficient to disturb the entire annular device, simultaneously moving every segment and reorienting every twisting axis. The chain-wide disturbance proceeds until two axis come into alignment. The initial resistance to change in the annular device is the origin of the configuration retention characteristic. This initial resistance is at least in part responsible for the self-supporting feature of sculpture 100 shown in FIG. 1. Minor displacement forces (such as gravity and occasional bumps) acting on the annular device are insufficient to overcome the non-alignment resistance.

MANUAL DIVERSION TRANQUILIZER

Hand action coupled with a low attention requirement is well known to have a tranquilizing effect. Crocheting and whittling are traditional examples of diversion-relaxation therapy. The present annular device provides a similar tension relief function. Twisting the device is a simple, thoughtless procedure, which instantly produces unlimited fascinating and unpredictable configurations. With each twist of the segments, the device undergoes a chain-wide transformation in silhouette and axis orientation without repetition. The device functions as a mechanical or sculptural kaleidoscope, with a corresponding relaxing, mesmeric characteristic.

The continuous center line of symmetry around the annular device insures that each of the infinite random configurations will have a smooth and graceful silhouette, which contributes to the relaxation of the user. The torus section embodiments produces only continuous configurations free from geometric or mathematical discontinuities (no infinite derivatives).

The annular device may be displayed as a stationary artistic sculpture without change, and still have a desirable therapeutic effect. The flowing appearance of the annular device contributes to a relaxing atmosphere.

Figure 3:
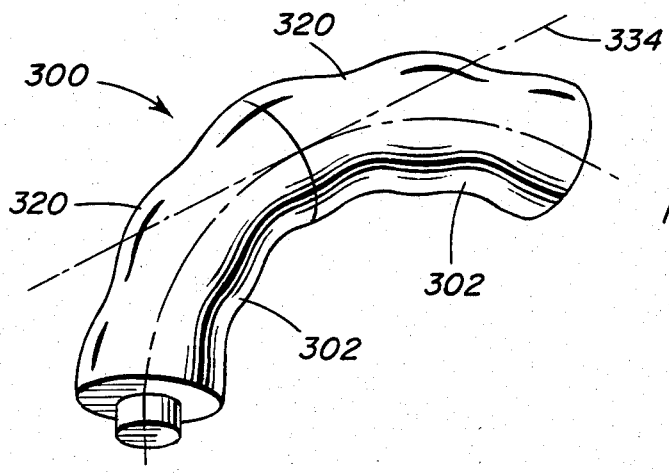
FIG. 3 is a perspective view of an irregular annular device having a smoothly deviating surface.

The non-torus embodiment 300 shown in FIG. 3, has a smoothly irregular or undulating surface along body portion 320 of each segment 302. The body portion proximate each end of each segment 302 is cylindrical of toroidal, to maintain a flush interface as the segments are twisted about mutual axis 334. Irregular embodiment 300 resembles a smooth, randomly convoluted piece of driftwood.

VARYING CHAIN LENGTHS AND SEGMENT SHAPES FIG. 4

Figure 4A:
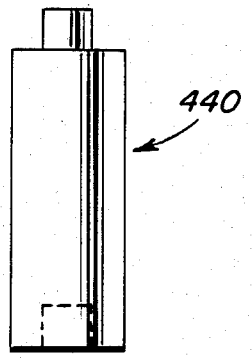
FIG. 4A is a straight segment.
Figure 4B:
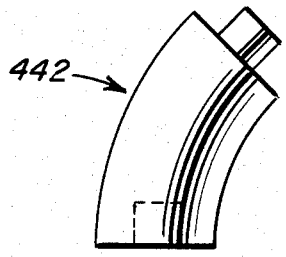
FIG. 4B is a shorter 45 degree torus segment.
Figure 4C:
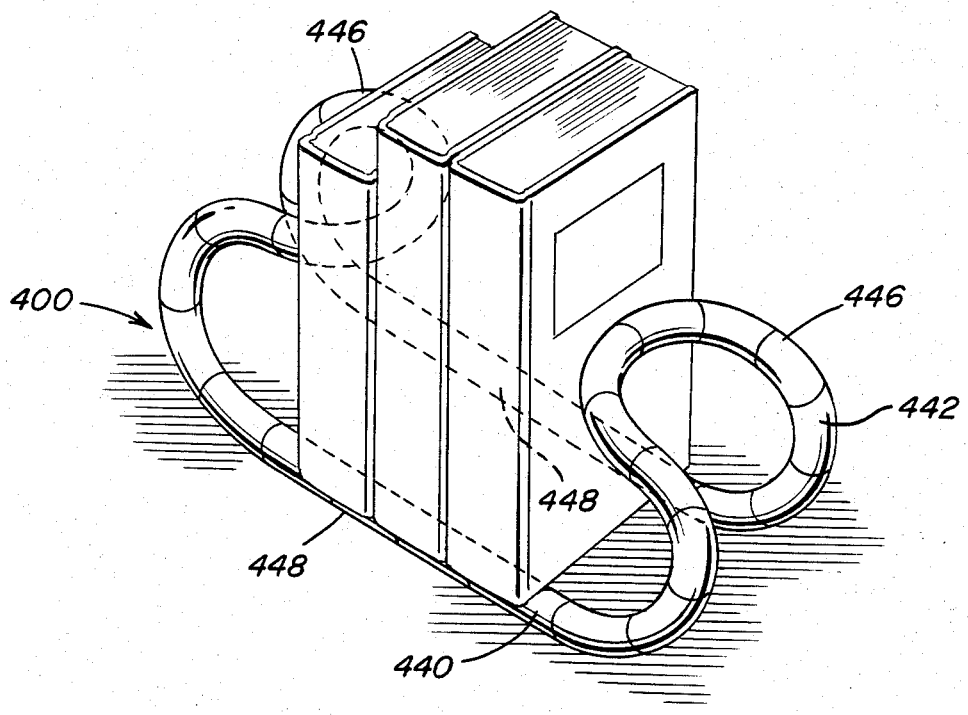
FIG. 4C is a perspective view of an elongated book rack formed by the straight segments of FIG. 4A and the short curved segments of FIG. 4B.

Any number of segments may be included in the annular annular device, to provide a wide range of configurations. Straight segments 440 (shown in FIG. 4A), and shorter curved segments 442 (shown in FIG. 4B) may also be employed in an annular device to modify the scope of possible configurations. FIG. 4C shows books rack 400 formed by twenty four 45 degree torus segments 442, and eight straight segments 440. The curved segments form opposed, elevated end supports 446. The straight segments form a pair of connecting rails 448 between the end rests. The introduction of adjacent straight segments reduces the scope of possible configurations because the straight portion has only one twisting axis common to each segment therein. The shorter curved segments increases the scope of possible configurations because of the higher number of twisting axis per unit length. However, the shorter torus segments tend to reduce the retention property of the annular device because of the smaller step in axis orientation.

INTERFACE STRUCTURE FIGS. 5 AND 6

Figure 5:
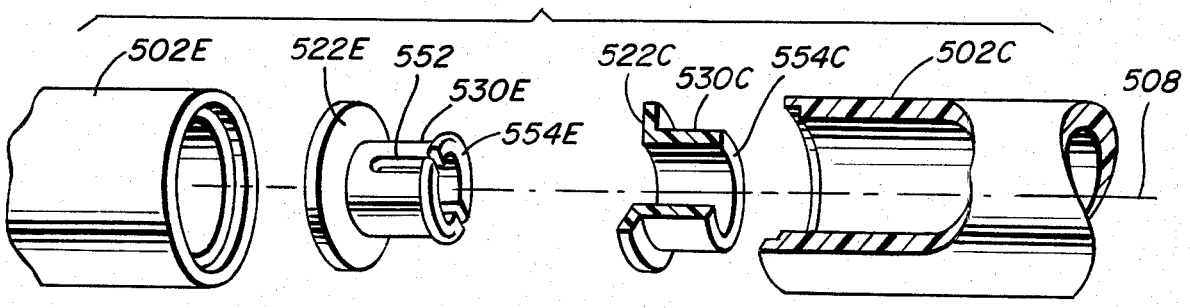
FIG. 5 is a perspective view of a bifurcated extension and a sectional view of a cooperating channel for retaining adjacent segments together.

The interface structure for retaining the annular device together may be an end face 522E with a simple central extension 530E, bonded onto the end of segment 502E (see FIG. 5). Longitudinal bifurcation 552 permits extension 530E to compress slightly and slip into cooperating central channel 530C in end face 522C bonded to segment 502C. Extension 530E has a radial locking flange 554E for engaging radial surface 554C at the inner end of within channel 530C. The radial nature of flange 554E and surface 554C permit segments 502 to twist around central axis 508.

Figure 6:
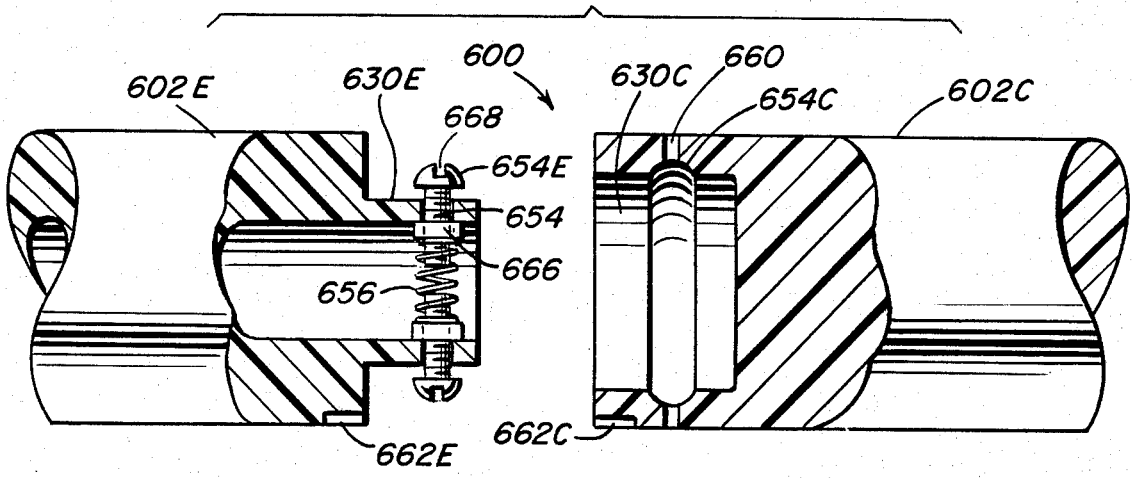
FIG. 6 is a sectional view of an extension with spring loaded detents and cooperating channel.

Alternatively, a more complex detent mechanism 600, such as shown in FIG. 6, may be employed. Extension 630E has opposed detents 654E which are urged radially outward by spring member 656. Detents are displaced inwardly slightly as segments 602E and 602C are joined, and spring outwardly to engage radial groove 654C in channel 630C, locking segments 602 together. Radial groove 654C extends completely around channel 630C permiting segments 602 to be twisted a full 360 degrees. Opposed release ports 660 are provided through segment 602C between the surface and groove 654C. The ports are placed in registration with the detents through registration marks 662E and 662C. While in registration, each port 660 receives a thin tool for depressing detents 654E simultaneously out of engagment with the groove 654C. The segments may then be separated by a longitudinal force.

The engagement pressure between detents 654E and groove 654C may be adjusted through ports 660. Each detent has a threaded body portion 664 which engages a cooperating threaded spring end member 666. A small screwdriver is inserted into one of the ports to engage slot 668 in one of the detents 654E. As the screwdriver is turned CW (or CCW), the detent is displaced radially inward (or outward) into softer (or harder) engagement with groove 654C.

For general use, the engagement is preferable soft enough to permit initial engagement of the segments with a firm pressure, and hard enough to maintain the engagement as the annular device is twisted. The outward engagement pressure may be adjusted to compensate for wear, humidity, thermal expansion etc.

The user may set the annular device in any predetermined, desired configuration; by tightening at least one detent at each interface prior to assembly of the device. Each interface becomes locked at the axis of insertion, and the entire annular device is frozen in the desired configuration. To release the annular device, each interface is separated and detents 654C are turned CW causing them to displace inwardly to a softer engagement pressure.

SPECIFIC EMBODIMENT

The following particulars of are given as an illustrative example of one embodiment of the annular device. In this example, each segment is made of conventional plastic molded in a hollow, torus quadrant, body portion with separate end pieces. The torus quadrant has a radius of revolution (first generator) of 4.1 cm, and a circle radius (second generator) of 0.9 cm. The central extension is 1 cm long by 0.4 cm in diameter, with a bifurcation and locking groove. The central channel is has a diameter slightly in excess of 0.9 cm to permit a snug but twistable fit, with a retaining flange for engaging the locking groove. The dimensions and material given above are not intended as defining the limitations of the invention. Numerous other dimensions and configurations are possible.

INDUSTRIAL APPLICABILITY

It will be apparent to those skilled in the art that the objects of this invention have been achieved by providing a an annular device of pivotally connected segments which may be twisted into many useful configurations. The random orientations of the twist axis between segments prevent the device from collapsing downward. An individual segment cannot be twisted or moved independently; but must be displaced as a unit with a set of adjacent segments. This configuration retention property permits the annular device to withstand normal "bumps" and "jars 38 without configuration degradation. The annular device which may be twisted into an infinite number of decorative configurations because each twist axis has complete rotational freedom. This infinite variation, and the continuous, flowing appearance of the device have a mesmeric effect on the user. The annular device has a tranquilizer function.

CONCLUSION

Clearly various changes may be made in the structure and embodiments shown herein without departing from the concept of the invention. For example the segments may be held together in an annular chain by opposed magnets mounted in the end faces, or by an elastic member extending through all of the segments. Further, the features and construction of the embodiments shown in the various Figures may be employed with the embodiments of the other Figures.

Therefore, the scope of the invention is to be determined by the terminology of the following claims and the legal equivalents thereof.

I claim as my invention:

1. A continuous annular device which may be twisted into an infinite variety of configurations, comprising:

a plurality of serially connected rigid segments having a first end pivotally secured to one of the two adjacent segments, and a second end pivotally secured to the other one of the two adjacent segment, permitting each segments to be twisted relative to the two adjacent segments causing the annular device to assume any one of an infinite number of configurations, each configuration having a continuous center line therearound;

a first end face on the first end of each segment, which end face is normal to the center line of the annular device defining a first interface plane for each segment, the first end of each segment forming a first interface with the cooperating end of the one of the two adjacent segments along the first interface plane with a pivot axis therethrough normal to the first interface plane;

a second end face on the second end of each segment, which end face is normal to the center line of the annular device defining a second interface plane for each segment, the second end of each segment forming a second interface with the cooperating end of the other one of the two adjacent segments along the first interface plane with a pivot axis therethrough normal to the first interface plane;

a first engagement means on the first end face of each segment; and a second engagement means on the second end face of each segment for engaging the first engagement means on the other one of the two adjacent segments for securing the plurality of segments together;

the first engagement means is a cylindrical central extension means extending from the first end face;

the second engagement means is a cylindrical central channel means extending into the second end face for pivotally engaging the extension means on the other one of the two adjacent segments, the extension means has an outward extending radial engagement means for engaging the channel means to pivotally secure the adjacent segments together;

the channel means has an outwardly extending radial surface for engaging the radial engagement means on the extension means;

the center axis of the cylindrical extension means is coincident with the center axis of the cooperating cylindrical channel means on the one adjacent segment forming a common pivot axis;

the continuous center line around the annular device is a line of radial symmetry around the annular device;

the coincident center axes are also coincident with the center line of radial symmetry at the interface plane between adjacent segments; and both the first end face and the second end face on each segment have a central depression with a raised circumferential rim.

2. The annular device of claim 1, wherein the extension means is bifurcated and separable from the channel means.

3. The annular device of claim 1, wherein the center axis of the cylindrical extension means is coincident with the center axis of the cooperating cylindrical channel means on the one adjacent segment forming a common pivot axis.

4. The annular device of claim 3, wherein the continuous center line around the annular device is a line of radial symmetry around the annular device.

5. The annular device of claim 4, wherein the coincident center axis are also coincident with the center line of radial symmetry at the interface plane between adjacent segments.

6. The annular device of claim 5, wherein all cross-sections through the end portions of the segments proximate either end face thereof which are normal to the center line of symmetry, are circular and identical.

7. The annular device of claim 6, wherein the surface of the segments between the round end portions has smooth undulations thereon.

8. The annular device of claim 5, wherein all cross-sections through any segment which are normal to the center line of symmetry, are circular and identical.

9. The annular device of claim 8, wherein each segment is identical.

10. The annular device of claim 1, wherein the extension means has a radially extending detent means for engaging the channel means.

11. The annular device of claim 10, further comprising a spring means supported by the extension means for urging the detent means outward.

12. The annular device of claim 11, wherein the channel means has a circumferential groove extending completely therearound for engaging the detent means while permitting the extension means to rotate within the channel means.

13. The annular device of claim 12, wherein the radially extending detent means is a pair of opposed detents radially extending in opposite directions.

14. The annular device of claim 12, further comprising access port means on the surface of the segment proximate the second end thereof, extending radially inward to the circumferential groove in the channel means.

15. The annular device of claim 14, wherein the spring means is adjustable to change the outward bias thereof urging the detent means against the circumferential groove.

16. The annular device of claim 15, further comprising:

threaded end member mounted on at least one end of the spring means; and threads on the detent means for engaging the threaded end member for adjusting the outward bias of the spring means.

17. The annular device of claim 16, wherein the detent means has a slot therein for turning the detent means and changing the position thereof relative to the threaded end member to adjust the outward bias of the spring means.

18. The annular device of claim 1, wherein at least a portion of the segments are formed by a section of a torus of revolution.

19. The annular device of claim 18, wherein all of the segments are one quarter torus sections.

20. The annular device of claim 18, wherein all of the segments are one eighth torus sections.

* * * * *